US011570533B2

(12) United States Patent
Jin et al.

(10) Patent No.: US 11,570,533 B2
(45) Date of Patent: Jan. 31, 2023

(54) SPEAKER DEVICE

(71) Applicant: AAC Microtech (Changzhou) Co., Ltd., Changzhou (CN)

(72) Inventors: Xin Jin, Shenzhen (CN); Zhiwei Zhong, Shenzhen (CN)

(73) Assignee: AAC Microtech (Changzhou) Co, , Ltd., Changzhou (CN)

( * ) Notice: Subject to any disclaimer, the term of this patent is extended or adjusted under 35 U.S.C. 154(b) by 0 days.

(21) Appl. No.: 17/536,109

(22) Filed: Nov. 29, 2021

(65) Prior Publication Data

US 2022/0174382 A1 Jun. 2, 2022

(30) Foreign Application Priority Data

Nov. 30, 2020 (CN) ..... 202022830543.X

(51) Int. Cl.
*H04R 1/02* (2006.01)
*H04R 9/02* (2006.01)
*H04R 9/06* (2006.01)

(52) U.S. Cl.
CPC ..... *H04R 1/021* (2013.01); *H04R 9/027* (2013.01); *H04R 9/06* (2013.01); *H04R 2209/027* (2013.01); *H04R 2400/07* (2013.01); *H04R 2400/11* (2013.01); *H04R 2499/11* (2013.01)

(58) Field of Classification Search
CPC ..... H04R 1/1021; H04R 9/027; H04R 9/06; H04R 2209/07; H04R 2400/11; H04R 2499/11
See application file for complete search history.

(56) References Cited

FOREIGN PATENT DOCUMENTS

CN 208638633 U * 3/2019 ..... H04R 7/127
CN 209897258 U * 1/2020

* cited by examiner

*Primary Examiner* — Sunita Joshi
(74) *Attorney, Agent, or Firm* — W&G Law Group

(57) ABSTRACT

A speaker device includes: a frame, a vibration unit and a magnetic circuit unit. The vibration unit includes a diaphragm and a voice coil. The magnetic circuit unit includes a yoke and a magnet. The yoke includes a yoke body, a yoke side wall and yoke extension portions protruding from the yoke side wall toward the frame. The magnet is fixed to the yoke body and is spaced apart from the yoke side wall to form a magnetic gap. The voice coil is inserted into the magnetic gap. The yoke side wall is fixed to the frame. The frame body includes a frame body having a ring shape, and frame fixing portions extending from the frame body toward the yoke side wall. The speaker device of the present disclosure can achieve a simple structure, high strength, easy assembly and positioning, and high reliability.

10 Claims, 7 Drawing Sheets

SPEAKER DEVICE

TECHNICAL FIELD

The present disclosure relates to the technical field of electro-acoustic conversion, and in particular, to a speaker device for a speaker enclosure product.

BACKGROUND

With the advent of the Internet era, the number of smart mobile devices is continuously rising. Among innumerous mobile devices, mobile phones are undoubtedly the most common and most portable mobile terminal devices. At present, mobile phones have extremely diverse functions, one of which is a high-quality music function. Therefore, speaker devices for playing music are widely used in smart mobile devices.

In the related art, a speaker device includes a frame, a vibration unit fixed to the frame and a magnetic circuit unit driving the vibration unit to vibrate and produce sound. The magnetic circuit unit includes a yoke fixed to the frame and a magnet accommodated in the yoke. The yoke is fixed to the frame by gluing.

However, since the frame of the speaker device is typically made of low-strength plastic, the speaker device is prone to be deformed. In addition, the yoke and the frame are prone to move when they are fixed by gluing, which makes it hard for the accurate positioning of the magnetic circuit unit, thereby leading to low reliability of the speaker device.

Therefore, it is necessary to provide a speaker device to solve the above technical problem.

SUMMARY

An objective of the present disclosure is to provide a speaker device, which achieves a simple structure, high strength, easy assembling and positioning, and high reliability.

In order to achieve the above objective, the present disclosure provides a speaker device. The speaker device includes a frame, a vibration unit fixed to the frame, and a magnetic circuit unit driving the vibration unit to vibrate and produce sound. The vibration unit includes a diaphragm fixed to the frame and a voice coil driving the diaphragm to vibrate. The magnetic circuit unit includes a yoke fixed to the frame and a magnet accommodated in the yoke. The yoke includes a yoke body and a yoke side wall bending and extending from a periphery of the yoke body toward the diaphragm. The magnet is fixed to the yoke body and is spaced apart from the yoke side wall to form a magnetic gap. The yoke side wall is fixed to the frame. The voice coil is inserted into the magnetic gap. The frame includes a frame body having a ring shape, and at least one frame fixing portion extending from the frame body to the yoke side wall. The yoke further includes at least one yoke extension portion protruding from the yoke side wall toward the frame. The at least one frame fixing portion abuts against the yoke side wall and abuts against a side of the at least one yoke extension portion close to the diaphragm. The at least one frame fixing portion is fixed to and connected to the at least one yoke extension portion.

As an improvement, the frame may be made of a metal material. A side of the at least one yoke extension portions away from the yoke side wall may be in contact with and fixed to the at least one frame fixing portion by laser welding.

As an improvement, at least one fusion protrusion may be provided respectively at the side of the at least one yoke extension portion away from the yoke side wall and at a side of the at least one frame fixing portion close to the at least one yoke extension portion. The at least one yoke extension portion may be fixed to the at least one frame fixing portion by welding through the at least one fusion protrusion.

As an improvement, the at least one fusion protrusion may include a plurality of fusion protrusions, which is spaced apart from each other and is symmetrically distributed on the at least one yoke extension portion and on the frame fixing portion.

As an improvement, the yoke has a rectangular structure. The at least one frame fixing portion may include two frame fixing portions, which are respectively located at two opposite sides of a long axis of the yoke. The at least one yoke extension portion may include two yoke extension portions, which are respectively located at two opposite sides of the long axis of the yoke. The two yoke extension portions are in a one-to-one correspondence with the two frame fixing portions.

As an improvement, the diaphragm may include a vibrating portion, a suspension portion bending and extending from an outer periphery of the vibrating portion, and a connecting portion bending and extending from the suspension portion toward the frame. The voice coil may be fixed to the vibrating portion. The connecting portion may be fixed to the frame body. The suspension portion has an arc-shaped structure recessing towards the yoke and may be directly opposite to the two frame fixing portions. A distance between the suspension portion and each of the two frame fixing portions may be greater than a maximum vibration amplitude of the suspension portion.

As an improvement, the diaphragm may further include a reinforcing portion having a ring shape and bending and extending from an outer periphery of the connecting portion toward the two frame fixing portions along an outer periphery of the frame body. The reinforcing portion may be fixed to the frame body.

As an improvement, the vibration unit may further include two elastic support assemblies, and a holder fixed to a side of the vibrating portion close to the magnetic circuit unit. The two elastic support assemblies may be respectively located at two opposite sides of a short axis of the yoke. Each of the two elastic support assemblies may include an end fixed to the frame body, and another end fixed to the holder. The voice coil may be connected to the diaphragm through the holder.

As an improvement, the holder may include a holder body having a ring shape and fixed to the vibrating portion, a first holder fixing portion extending from an outer periphery of the holder body toward the yoke body, and at least one second holder fixing portion extending from an inner periphery of the holder body toward the voice coil. Each of the two elastic support assemblies may be connected to an end of the first holder fixing portion away from the holder body. The voice coil may be connected to the at least one second holder fixing portion.

As an improvement, the at least one second holder fixing portion may include at least two second holder fixing portions. Adjacent ones of the at least two second holder fixing portions may be spaced apart to form a leakage channel.

As an improvement, the yoke side wall has a ring shape and may surround an outer periphery of the voice coil.

Compared with the related art, in the speaker device of the present disclosure, the frame body of the frame extends beyond the frame fixing portion, and the yoke side wall of the yoke protrudes towards the frame to form the yoke extension portion. The frame fixing portion abuts against the yoke side wall and abuts against a side of the yoke extension portion close to the diaphragm, and is fixedly connected to the yoke extension portion. This structure uses the position of the yoke extension portion as a height positioning surface of the yoke, so that the magnetic circuit unit and the frame are assembled and positioned accurately, and a sufficient vibration space is reserved for the vibration unit. Meanwhile, the yoke extension portion is fixed to and connected to the frame fixing portion. This structure is simple, and the frame and the yoke are not prone to move, so that the fixing stability of the frame and the yoke are effectively achieved, thereby improving the reliability of the speaker device.

BRIEF DESCRIPTION OF DRAWINGS

Many aspects of the exemplary embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION OF EMBODIMENTS

The technical solutions in the embodiments of the present disclosure are clearly and completely described below with reference to the drawings in the embodiments of the present disclosure. Apparently, the embodiments described are a part, rather than all of the embodiments of the present disclosure. All other embodiments obtained by those skilled in the art based on the embodiments in the present disclosure without creative efforts should fall within the protection scope of the present disclosure.

Figure 1:
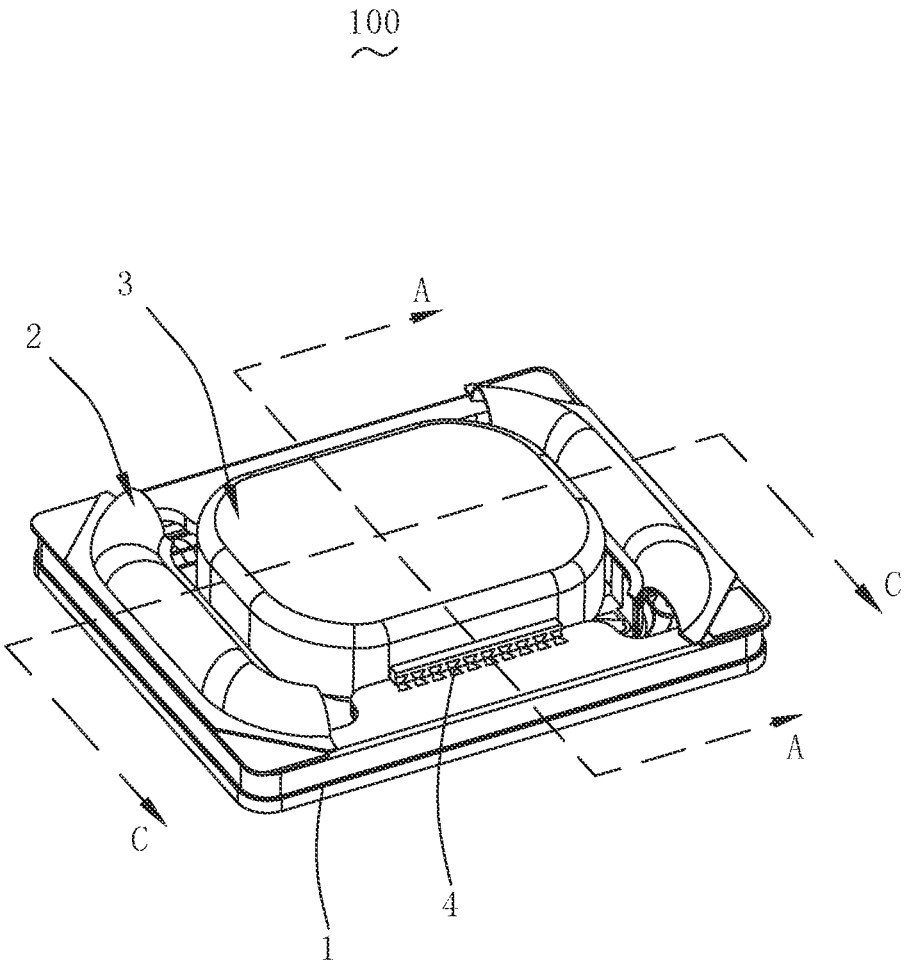
FIG. 1 is a three-dimensional view illustrating a structure of a speaker device according to an embodiment of the present disclosure.
Figure 2:
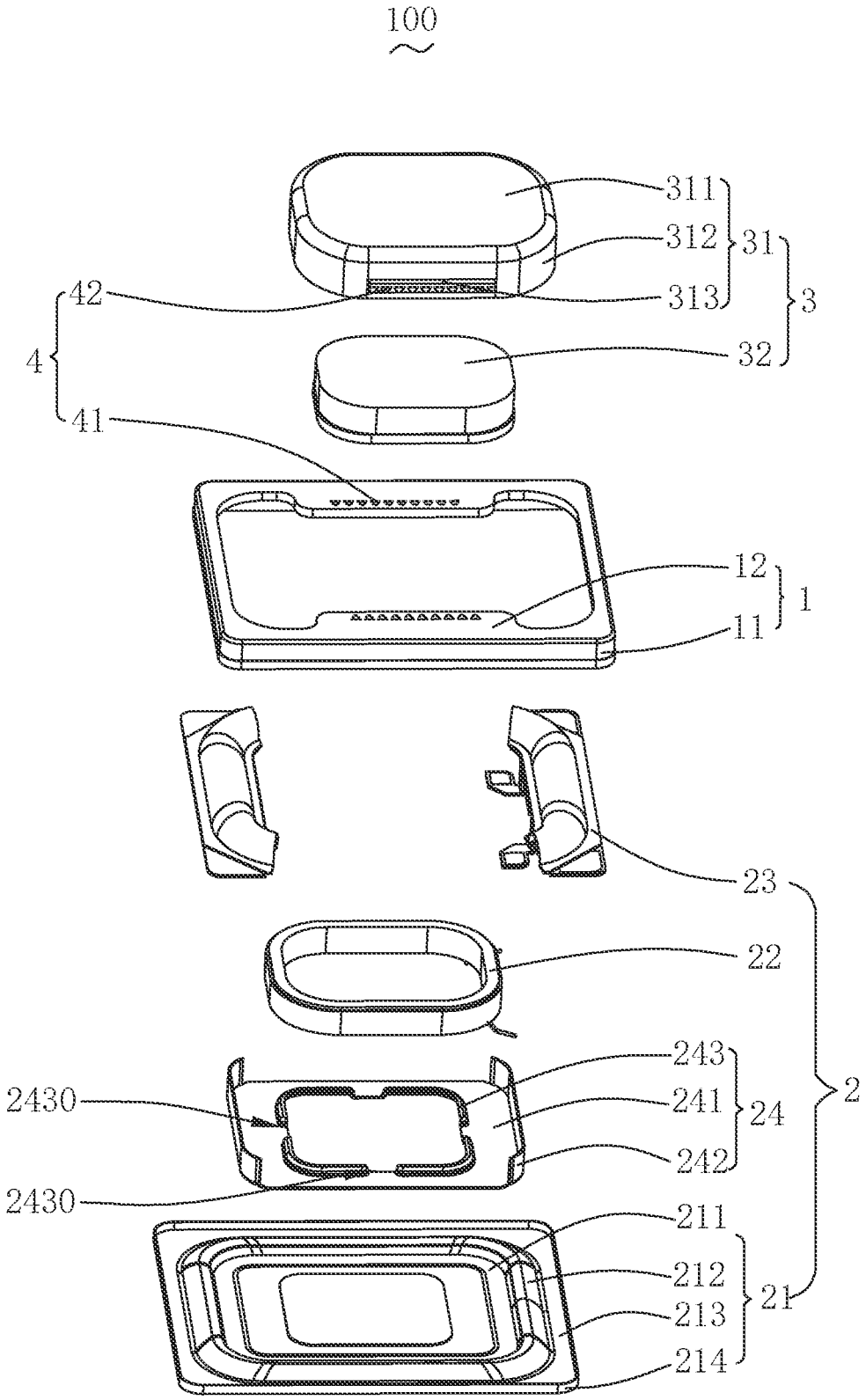
FIG. 2 is a partial three-dimensional exploded view illustrating a structure of the speaker device according to an embodiment the present disclosure.
Figure 3:
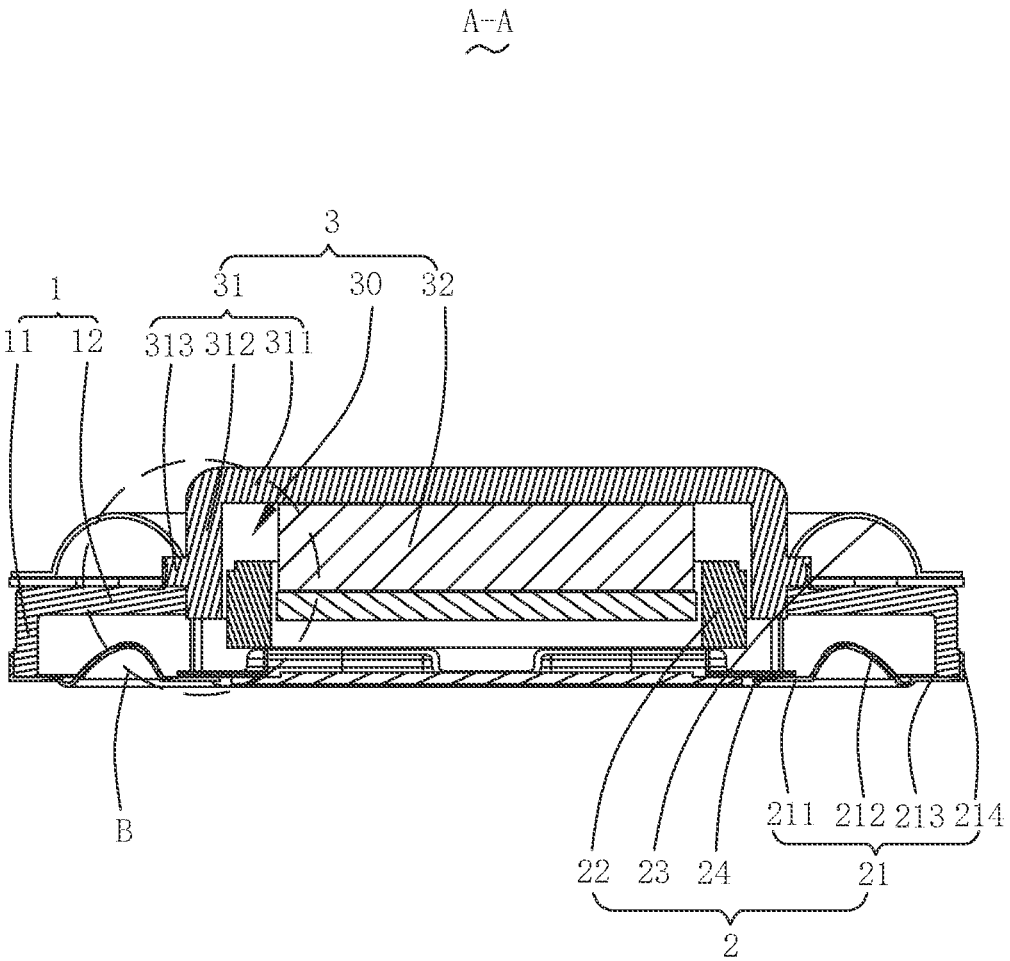
FIG. 3 is a cross-sectional view taken along line A-A shown in FIG. 1 according to an embodiment the present disclosure.
Figure 4:
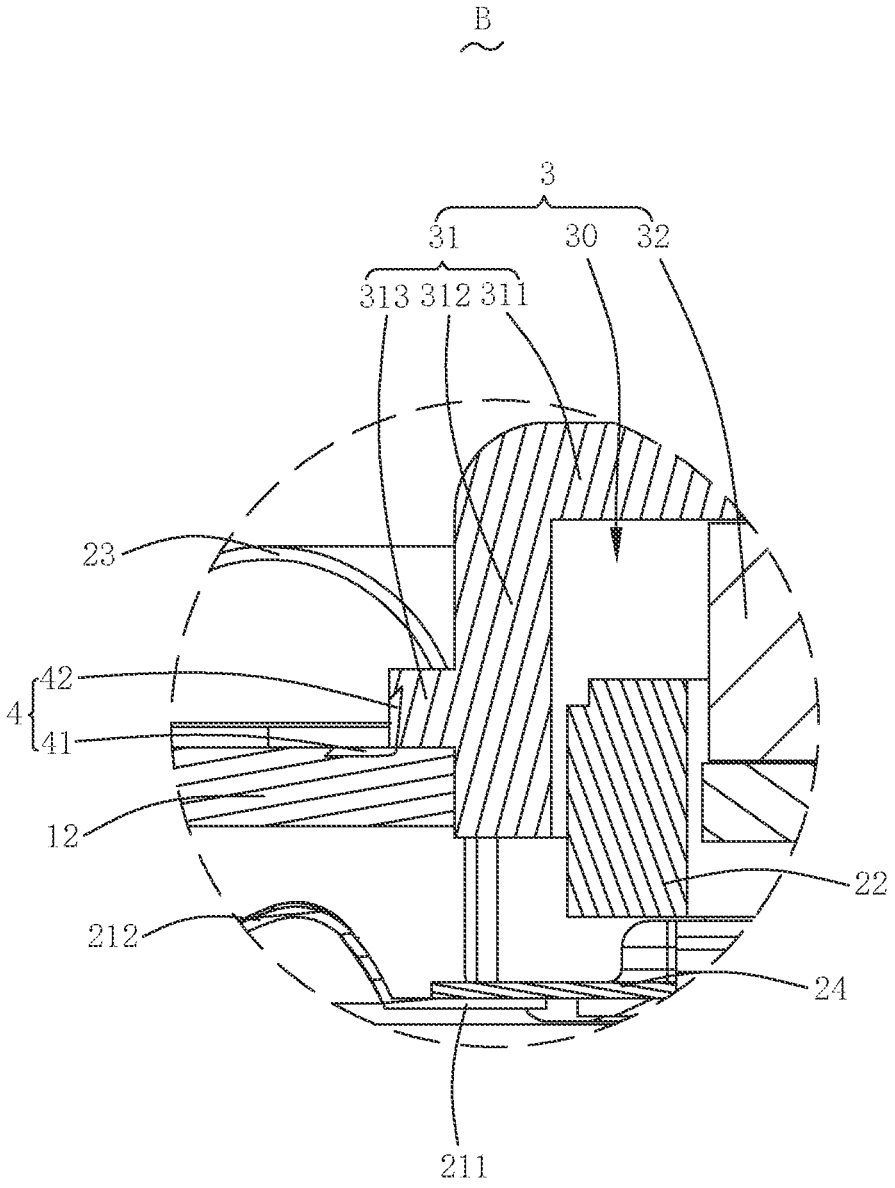
FIG. 4 is an enlarged view of B shown in FIG. 3 according to an embodiment the present disclosure.
Figure 5:
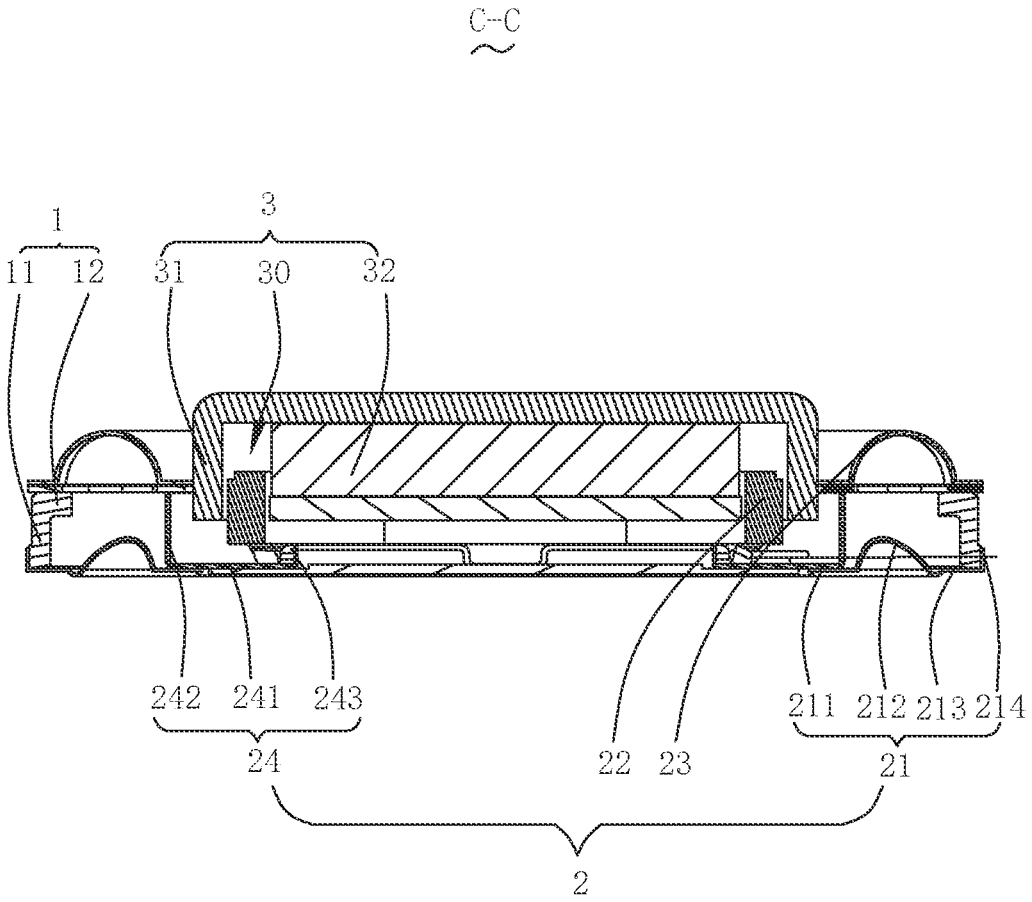
FIG. 5 is a cross-sectional view taken along line C-C shown in FIG. 1 according to an embodiment the present disclosure.
Figure 6:
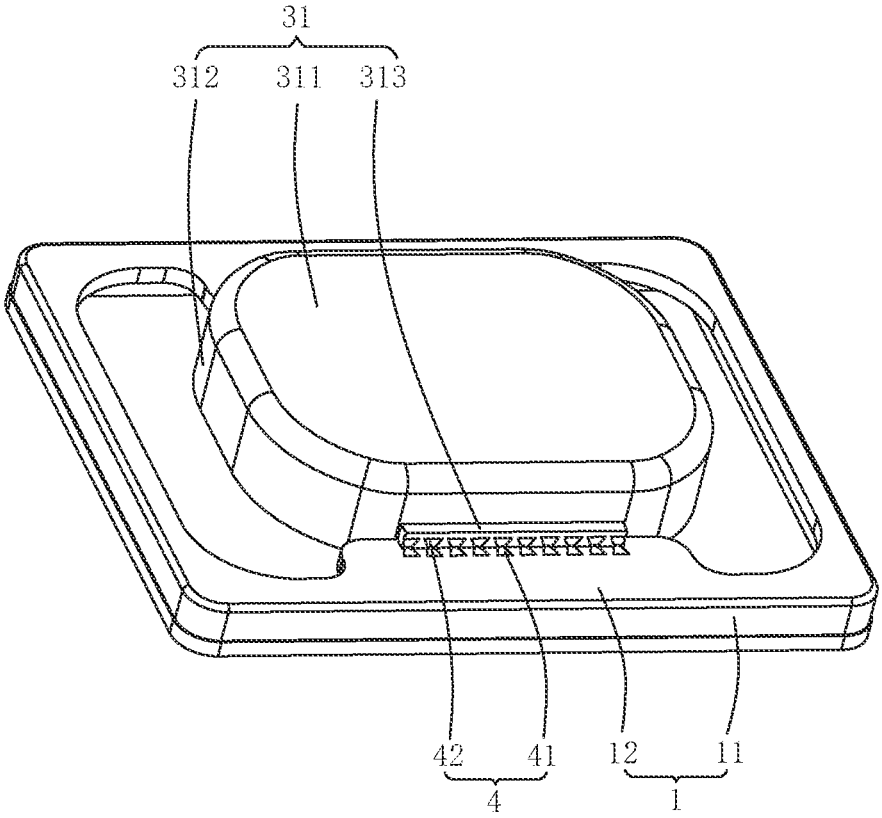
FIG. 6 is a three-dimensional view illustrating a structure of a yoke and a frame of the speaker device after assembly according to an embodiment the present disclosure.
Figure 7:
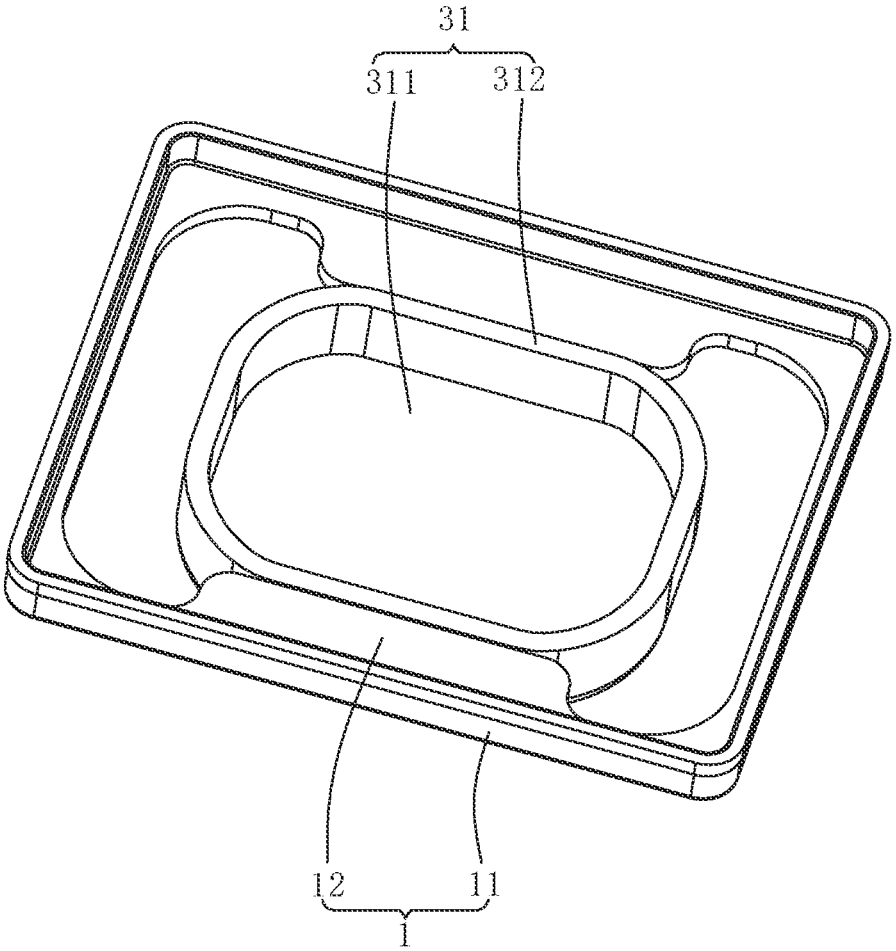
FIG. 7 is a three-dimensional view illustrating a structure of the yoke and the frame of the speaker device after assembly from another angle according to an embodiment the present disclosure.

Referring to FIG. 1 to FIG. 7, the present disclosure provides a speaker device 100. The speaker device 100 includes a frame 1, a vibration unit 2 fixed to the frame 1, and a magnetic circuit unit 3 driving the vibration unit 2 to vibrate and produce sound.

In an embodiment, the frame 1 is made of a metal, so that the frame 1 has high hardness and is not easy to be deformed during use and assembly, thereby improving the reliability of the speaker device 100.

In an embodiment, the frame 1 includes a frame body 11 and a frame fixing portion 12.

The frame body 11 is ring-shaped. The frame body 11 is configured to fix the vibration unit 2.

The frame fixing portion 12 is extends from the frame body 11. The frame fixing portion 12 is configured to fix the magnetic circuit unit 3 by laser welding.

The vibration unit 2 includes a diaphragm 21, a voice coil 22, an elastic support member 23 and a holder 24.

The diaphragm 21 is fixed to a side of the frame body 11 away from a yoke 31.

The diaphragm 21 includes a vibrating portion 211, a suspension portion 212 bending and extending from an outer periphery of the vibrating portion 211, and a connecting portion 213 bending and extending from the suspension portion 212 toward the frame 1.

The connecting portion 213 is fixed to the frame body 11.

The suspension portion 212 is an arc-shaped structure formed by recessing towards the yoke 31 and directly faces the frame fixing portions 12. A distance between the suspension portion 212 and the frame fixing portions 12 is greater than a maximum vibration amplitude of the suspension portion 212.

In this embodiment, in order to enhance the fixing strength between the diaphragm 21 and the frame body 11, the diaphragm 21 further includes a ring-shaped reinforcing portion 214 that bends and extends from an outer periphery of the connecting portion 213 toward the frame fixing portions 12 along an outer periphery of the frame body 11. The reinforcing portion 214 is fixed to the frame body 11. With such a structure, when the diaphragm 21 vibrates and produces sound, the diaphragm 21 is prevented from dropping from the frame body 11 to cause a poor acoustic effect of the speaker device 100, thereby improving the reliability of the speaker device 100.

The voice coil 22 is configured to drive the diaphragm 21 to vibrate and produce sound. The voice coil 22 is fixed to the vibrating portion 211. In an embodiment, the voice coil 22 is connected to the diaphragm 21 through the holder 24.

The elastic support member 23 is fixed to the frame 1. In an embodiment, one end of the elastic support member 23 is fixed to the frame body 11, and the other end of the elastic support member 23 is fixed to the holder 24. The elastic support member 23 is configured to balance the vibration of the voice coil 22, and supports the voice coil 22 more stably, thereby achieving better vibration reliability.

The holder 24 is fixed to a side of the vibrating portion 211 close to the magnetic circuit unit 3. The holder 24 includes a ring-shaped holder body 241 fixed to the vibrating portion 211, a first holder fixing portion 242 extending from an outer periphery of the holder body 241 to the magnetic circuit unit 3, and a second holder fixing portion 243 extending from an inner periphery of the holder body 241 to the voice coil 22. The elastic support member 23 is connected to an end of the first holder fixing portion 242 away from the holder body 241. The voice coil 22 is connected to the second holder fixing portions 243. With such a structure, the voice coil 22 drives the diaphragm 21 to vibrate and produce sound through the holder 24, and is connected to the elastic support member 23, thereby achieving the vibration balance and high feasibility.

In an embodiment, there are at least two second holder fixing portions 243. Adjacent second holder fixing portions 243 are spaced apart to form a leakage channel 2430. The structure of the leakage channel 2430 is beneficial to balancing the air pressure inside and outside the voice coil 22, so that a good acoustic effect of the diaphragm 21 driven by the voice coil 22 is obtained, thereby achieving a desirable acoustic effect of the speaker device 100.

The magnetic circuit unit 3 includes a yoke 31 fixed to the frame 1 and a magnet 32 accommodated in the yoke 31.

The yoke 31 includes a yoke body 311, a yoke side wall 312 bending and extending from a periphery of the yoke body 311 toward the diaphragm 21, and a yoke extension portion 313 protruding from the yoke side wall 312 toward the frame 1.

The yoke body 311 is configured to fix the magnet 32. The first holder fixing portion 242 extends from the outer periphery of the holder body 241 to the yoke body 311. The yoke body 311 and the diaphragm 21 are located at two opposite sides of the speaker device 100, respectively.

In an embodiment, the yoke side wall 312 has a ring shape, and surrounds an outer periphery of the voice coil 22. In this structure, since the yoke 31 surrounds the voice coil 22 for a complete circle to conduct magnetism without any notch, magnetic lines in the magnetic circuit unit 3 are restricted inside the yoke side wall 312, so that the performance of the magnetic circuit unit 3 is optimized, thereby improving the acoustic effect of the speaker device 100.

The frame fixing portion 12 is formed by extending from the frame body 11 to the yoke side wall 312.

The yoke extension portion 313 is configured to assemble and position the magnetic circuit unit 3, and reserve a sufficient vibration space for the vibration unit 2.

The frame fixing portion 12 abuts against the yoke side wall 312 and a side of the yoke extension portion 313 close to the diaphragm 21 to form a fixedly connection. This structure is used to assemble and position the magnetic circuit unit 3 and the frame 1. In an embodiment, this structure uses the location of the yoke extension portions 313 as a height positioning surface of the yoke 31, so that the magnetic circuit unit 3 and the frame 1 are assembled and positioned accurately, and a sufficient vibration space is reserved for the vibration unit 2. That is, this structure ensures that the distance between the suspension portion 212 and the frame fixing portions 12 is greater than the maximum vibration amplitude of the suspension portion 212.

In an embodiment, a side of the yoke extension portion 313 away from the yoke side wall 312 is fixed to the frame fixing portions 12 by laser welding. Through the fixing of laser welding, on the one hand, the frame fixing portion 12 is fixedly to the yoke extension portion 313, thereby improving the reliability. In addition, laser welding can be performed on outer sides of the frame 1 and the yoke 31, and oblique laser welding is simple to operate, which facilitates the assembly and mass production of the speaker device 100.

A side of the yoke extension portion 313 away from the yoke side wall 312 and a side of the frame fixing portion 12 close to the yoke extension portion 313 are provided with a fusion protrusion 4, respectively. The metal material of the frame fixing portion 12 and the material of the yoke extension portion 313 are fused to form the fusion protrusion 4 by laser welding. The yoke extension portion 313 and the frame fixing portions 12 are welded to fix through the fusion protrusion 4. The fusion protrusion 4 is located at junctions between the yoke extension portion 313 the frame fixing portion 12.

In an embodiment, there are a plurality of fusion protrusions 4. The fusion protrusions 4 are spaced apart from each other and are symmetrically distributed on the yoke extension portion 313 and on the frame fixing portion 312. The plurality of fusion protrusion 4 distributed symmetrically are formed by spot welding. This structure realizes a simple assembly process, and makes the frame fixing portion 12 and the yoke extension portion 313 be welded firmly, thereby improving the reliability of the speaker device 100.

In an embodiment, the fusion protrusion 4 includes a first fusion protrusion 41 located at the frame fixing portion 12, and a second fusion protrusion 42 located at the yoke extension portion 313. The first fusion protrusion 41 and the second fusion protrusion 42 are connected to form an integrated structure. This structure utilizes the simple operation of oblique laser welding, which facilitates the assembly and mass production of the speaker device 100, and makes the frame fixing portion 12 and the yoke extension portion 313 be welded firmly, thereby improving the reliability.

The magnet 32 is fixed to the yoke body 311 and is spaced apart from the yoke side wall 312 to form a magnetic gap 30. The voice coil 22 is inserted into the magnetic gap 30. The first holder fixing portion 242 extend from the outer periphery of the holder body 241 to the yoke body 311, and is located at a side of the yoke side wall 312 away from the voice coil 22.

In an embodiment, the yoke 31 has a rectangular structure. There are two yoke extension portions 313 respectively located at two opposite sides of a long axis of the yoke 31. Through the symmetrically arranged yoke extension portions 313, the frame 1 is firmly fixed to the yoke 31, which improves the reliability of the speaker device 100. In addition, the magnetic circuit unit 3 and the frame 1 are accurately assembled and positioned, thereby ensuring the reliability of the suspension portion 312 under maximum vibration. Two frame fixing portions 12 are respectively located at two opposite sides of the long axis of the yoke 31. The yoke extension portions 313 correspond to the frame fixing portions 12, respectively. The frame fixing portions 12 are symmetrically arranged, which makes the frame fixing portions 12 welded firmly with the yoke extension portions 313, thereby improving the reliability of the speaker device 100.

Two elastic support members 23 are respectively located at two opposite sides of a short axis of the yoke 31. The two symmetrically distributed elastic support members 23 support the voice coil 22 stably, thereby improving vibration reliability.

Compared with the related art, in the speaker device of the present disclosure, the frame body of the frame extends beyond the frame fixing portion, and the yoke side wall of the yoke protrudes towards the frame to form the yoke extension portion. The frame fixing portion abuts against the yoke side wall and abuts against a side of the yoke extension portion close to the diaphragm, and is fixedly connected to the yoke extension portion. This structure uses the position of the yoke extension portion as a height positioning surface of the yoke, so that the magnetic circuit unit and the frame are assembled and positioned accurately, and a sufficient vibration space is reserved for the vibration unit. Meanwhile, the yoke extension portion is fixed to and connected to the frame fixing portion. This structure is simple, and the frame and the yoke are not prone to move, so that the fixing stability of the frame and the yoke are effectively achieved, thereby improving the reliability of the speaker device.

The above are merely some embodiments of the present disclosure. It should be noted that for those skilled in the art, modifications can be made without departing from the inventive concept of the present disclosure, but these all fall into the protection scope of the present disclosure.

What is claimed is:

1. A speaker device, comprising: a frame; a vibration unit fixed to the frame; and a magnetic circuit unit driving the vibration unit to vibrate and produce sound; wherein the vibration unit comprises a diaphragm fixed to the frame and a voice coil driving the diaphragm to vibrate;

the magnetic circuit unit comprises a yoke fixed to the frame and a magnet accommodated in the yoke; the yoke comprises a yoke body and a yoke side wall bending and extending from a periphery of the yoke body toward the diaphragm; the magnet is fixed to the yoke body and is spaced apart from the yoke side wall to form a magnetic gap; the yoke side wall is fixed to the frame; and the voice coil is inserted into the magnetic gap;

the frame comprises a frame body having a ring shape, and at least one frame fixing portion extending from the frame body to the yoke side wall;

the yoke further comprises at least one yoke extension portion protruding from the yoke side wall toward the frame; and the at least one frame fixing portion abuts against the yoke side wall and abuts against a side of the at least one yoke extension portion close to the diaphragm, and the at least one frame fixing portion is fixed to and connected to the at least one yoke extension portion;

wherein the frame is made of a metal material; and a side of the at least one yoke extension portions away from the yoke side wall is in contact with and fixed to the at least one frame fixing portion by laser welding.

2. The speaker device as described in claim 1, wherein at least one fusion protrusion is provided respectively at the side of the at least one yoke extension portion away from the yoke side wall and at a side of the at least one frame fixing portion close to the at least one yoke extension portion; and the at least one yoke extension portion is fixed to the at least one frame fixing portion by welding through the at least one fusion protrusion.

3. The speaker device as described in claim 2, wherein the at least one fusion protrusion comprises a plurality of fusion protrusions, which is spaced apart from each other and is symmetrically distributed on the at least one yoke extension portion and on the frame fixing portion.

4. The speaker device as described in claim 1, wherein the yoke has a rectangular structure; the at least one frame fixing portion comprises two frame fixing portions, which are respectively located at two opposite sides of a long axis of the yoke; the at least one yoke extension portion comprises two yoke extension portions, which are respectively located at two opposite sides of the long axis of the yoke; and the two yoke extension portions are in a one-to-one correspondence with the two frame fixing portions.

5. The speaker device as described in claim 4, wherein the diaphragm comprises a vibrating portion, a suspension portion bending and extending from an outer periphery of the vibrating portion, and a connecting portion bending and extending from the suspension portion toward the frame; the voice coil is fixed to the vibrating portion; the connecting portion is fixed to the frame body; the suspension portion has an arc-shaped structure recessing towards the yoke and is directly opposite to the two frame fixing portions; and a distance between the suspension portion and each of the two frame fixing portions is greater than a maximum vibration amplitude of the suspension portion.

6. The speaker device as described in claim 5, wherein the diaphragm further comprises a reinforcing portion having a ring shape and bending and extending from an outer periphery of the connecting portion toward the two frame fixing portions along an outer periphery of the frame body; and the reinforcing portion is fixed to the frame body.

7. The speaker device as described in claim 6, wherein the vibration unit further comprises two elastic support assemblies, and a holder fixed to a side of the vibrating portion close to the magnetic circuit unit; the two elastic support assemblies are respectively located at two opposite sides of a short axis of the yoke; each of the two elastic support assemblies comprises an end fixed to the frame body, and another end fixed to the holder; and the voice coil is connected to the diaphragm through the holder.

8. The speaker device as described in claim 7, wherein the holder comprises a holder body having a ring shape and fixed to the vibrating portion, a first holder fixing portion extending from an outer periphery of the holder body toward the yoke body, and at least one second holder fixing portion extending from an inner periphery of the holder body toward the voice coil; each of the two elastic support assemblies is connected to an end of the first holder fixing portion away from the holder body; and the voice coil is connected to the at least one second holder fixing portion.

9. The speaker device as described in claim 8, wherein the at least one second holder fixing portion comprises at least two second holder fixing portions, and adjacent ones of the at least two second holder fixing portions are spaced apart to form a leakage channel.

10. The speaker device as described in claim 1, wherein the yoke side wall has a ring shape and surrounds an outer periphery of the voice coil.

* * * * *